United States Patent [19]

Skinner

[11] 4,383,806

[45] May 17, 1983

[54] FUEL PUMPING APPARATUS

[75] Inventor: Robert T. J. Skinner, High Wycombe, England

[73] Assignee: Lucas Industries Limited, Birmingham, England

[21] Appl. No.: 196,389

[22] Filed: Oct. 14, 1980

[30] Foreign Application Priority Data

Nov. 22, 1979 [GB] United Kingdom ..... 7940461

[51] Int. Cl.[3] ..... F04B 19/00; F04B 29/00

[52] U.S. Cl. ..... 417/462

[58] Field of Search ..... 417/462, 214

[56] References Cited

U.S. PATENT DOCUMENTS 4,173,959 11/1979 Sosnowski ..... 417/462

4,282,843 8/1981 Seilly ..... 417/462

FOREIGN PATENT DOCUMENTS 934453 5/1955 Fed. Rep. of Germany ..... 417/462

2717323 11/1977 Fed. Rep. of Germany ..... 417/462

916617 1/1963 United Kingdom ..... 417/462

*Primary Examiner*—William L. Freeh

[57] ABSTRACT

A rotary drive fuel pump includes a rotary distributor member including a head, in which is located a reciprocable plunger. A ring surrounds the head and has a circumferential recess in which is located a roller. A follower is engaged with the plunger and is engageable with the roller to effect inward movement of the plunger. The roller rolls in the recess after maximum inward movement has taken place to allow rapid outward movement of the plunger.

8 Claims, 5 Drawing Figures

FUEL PUMPING APPARATUS

This invention relates to rotary drive fuel injection pumps for supplying fuel to an internal combustion engine and of the kind comprising a rotary member driven in use, in timed relationship with an associated engine, a bore formed in the rotary member, a plunger in said bore, means for imparting inward movement to said plunger as the rotary member rotates, passage means for conveying fuel displaced from said bore, whilst the plunger is moved inwardly, to an outlet which in use is connected to an injection nozzle of the engine, the means for imparting inward movement allowing limited outward movement of the plunger whilst the bore is in communication with the outlet.

Such pumps are well known in the art and it is the practice for the aforesaid means to comprise a roller carried in a shoe which is engaged by the plunger, the roller engaging a surface of a cam ring which has a cam lobe projecting from said surface. The aforesaid limited outward movement is provided by a dwell on the trailing flank of the cam lobe and the reason for allowing the limited outward movement of the plunger is to lower the pressure in the various passages in the pump and in the pipeline connecting the outlet with the injection nozzle, as quickly as possible so that the valve in the injection nozzle closes quickly. There is a lower limit to the size of the nose of the cam lobe and hence with this type of pump the reduction in pressure may not occur as quickly as is desired and certainly not as quickly as can be achieved in other forms of pump.

The object of the present invention is to provide a pump of the kind specified in a form in which rapid reduction in the pressure in the various passages of the pump and the pipeline connecting the outlet of the pump with an injection nozzle, can be obtained.

According to the invention in a pump of the kind specified the means for imparting inward movement to the plunger comprises a follower operatively connected to the plunger and rotatable therewith, and a roller located in a recess in a part retained against rotational movement, said recess extending in the direction of rotation of the rotary member, the arrangement being such that when the follower engages the roller the latter is driven against one end wall of the recess and inward movement is imparted to the plunger, the roller being driven away from said end wall as the follower moves over the roller thereby allowing rapid outward movement of the plunger.

Reference will now be made to the accompanying drawings in which.

Figure 1:
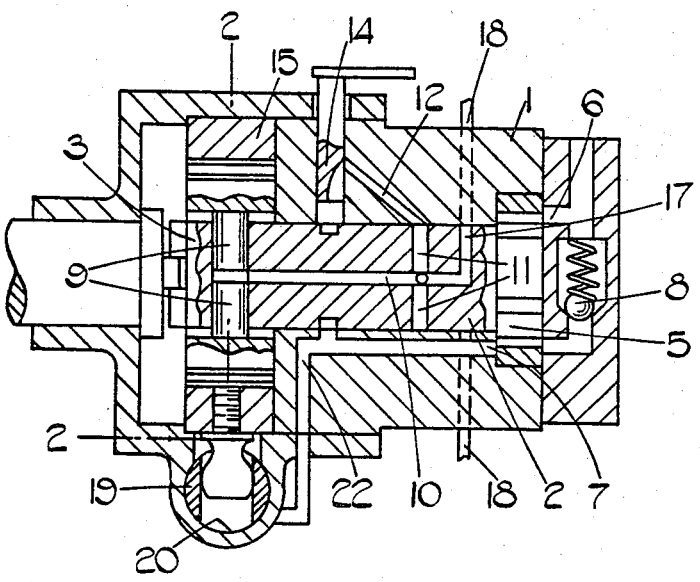
FIG. 1 is a cross-sectional side elevation of a known form of pump.
Figure 2:
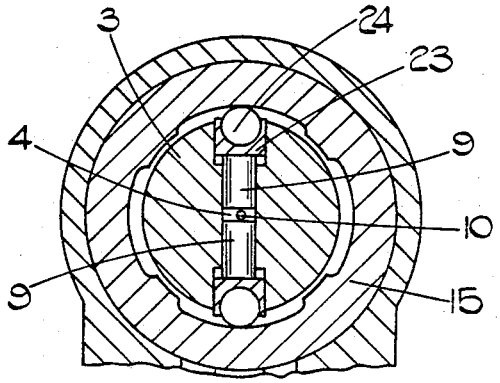
FIG. 2. PRIOR ART
FIG. 2 is a section on the line 2—2 of FIG. 1.

Referring to FIGS. 1 and 2 of the drawings the pump comprises a body part 1 in which is mounted a rotary cylindrical distributor member 2 having formed at one end a head 3 mounting in a bore, a pair of reciprocable pumping plungers 9. The pumping plungers are arranged to be moved inwardly as the distributor member is rotated by the action of a plurality of cam lobes projecting inwardly of the internal peripheral surface of an annular cam ring 15 which surrounds the distributor member. Also formed in the distributor member is a longitudinal bore 10 which at one point is in communication with an outwardly extending delivery passage 17 which is arranged to register in turn and as the distributor member rotates with a plurality of outlet ports 18 which in use are connected to injection nozzles respectively mounted on the associated engine.

At another point the longitudinal passage is in communication with a plurality of equi-angularly disposed and radially extending inlet passages 11 which register in turn, as the distributor member rotates, with an inlet port 12 formed in the body part. The communication between an inlet passage 11 and an inlet port 12 occurs during the time when the plungers 9 are permitted to move outwardly by the cam lobes and the communication of the delivery passage 17 with one of the outlet ports 18 occurs prior to inward movement of the plungers by the action of the cam lobes. It will be noted that the plungers 9 at their outer ends engage shoes 23 which carry rollers 24 the axes of the rollers being disposed parallel to the axis of rotation of the distributor member.

At the opposite end of the distributor member to the bore accommodating the plungers, is mounted the rotor of a vane type feed pump 5 having an inlet 6 and an outlet 7 in the body part. The inlet 6 of the feed pump in use is connected to a source of liquid fuel and the inlet and outlet are interconnected by way of a valve 8 which controls the output pressure of the feed pump in such a manner that it varies in accordance with the speed at which the apparatus is driven. Since the distributor member is driven by the engine the output pressure of the feed pump is also dependant upon the speed of the engine and the outlet of the feed pump is in communication with the aforesaid inlet port 12 by way of an adjustable throttle valve 14 whereby the quantity of fuel which flows through the inlet port 12 whilst the plungers are capable of moving outwardly can be varied. The throttle valve consists of an angularly adjustable cylindrical member the setting of which is controlled by a speed responsive governor not shown. The cam ring 15 is angularly adjustable within the body part for the purpose of varying the timing of delivery of fuel to the engine. The cam ring is in known manner, connected to a fluid pressure operable piston 19 which is located within a cylinder 20 which is tangentially disposed relative to the cam ring. The piston is loaded by a coiled compression spring towards the retarded position and a passage 22 connects the outlet 7 of the feed pump with the cylinder 20 so that the position of the piston is dependent upon the output pressure of the pump.

Although not shown in FIG. 2, the trailing flanks of the cam lobes include a dwell period and the purpose of this dwell period is to permit after the plungers have been moved inwardly, limited outward movement thereof to effect a reduction in the pressure of fuel in the passages within the distributor member and moreover in the pipeline connecting the outlet which communicates with the delivery passage 17, and the associated injection nozzle. During the dwell period the delivery passage 17 is moved out of register with an outlet.

It is sometimes desirable that the reduction in pressure which occurs when the plungers are permitted to move outwardly the limited amount, should be rapid. It is sometimes not possible to achieve the desired rate of reduction of pressure because of physical limitations imposed upon the minimum radius of the nose of the cam lobe. In order to achieve a more rapid reduction in the fuel pressure the construction which is shown in FIG. 3 is adopted.

Figure 3:
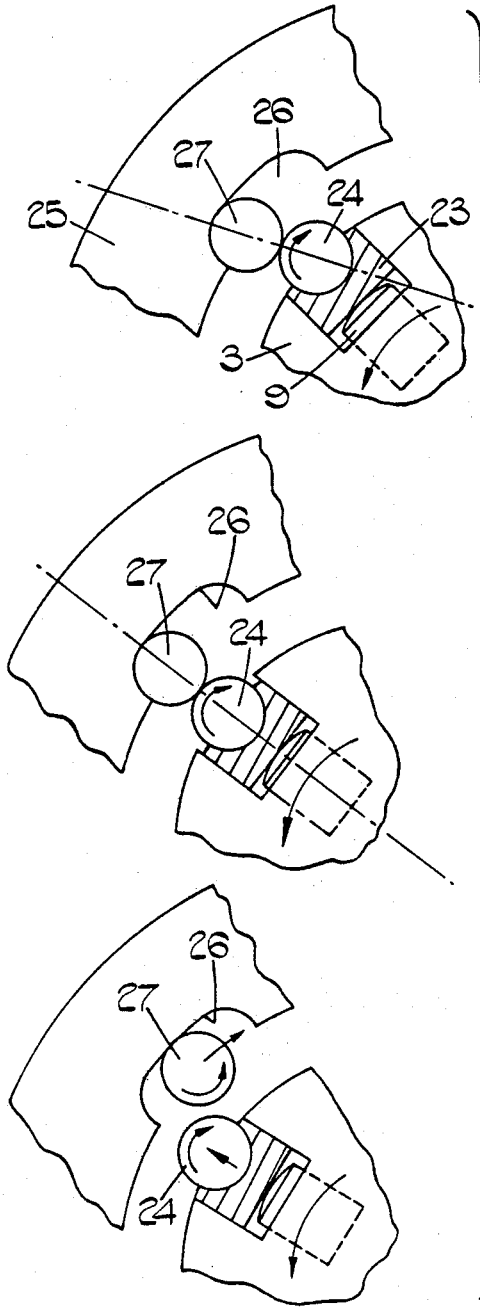
FIG. 3 shows the modification in accordance with the invention, and also shows three alternative settings.

Turning now to FIG. 3, the cam ring 15 is replaced by a ring 25 in the internal surface of which are formed in the particular example, 4 equi-anngularly spaced recesses 26. The recesses 26 have a width equal to the width of the ring 25 and extend in the circumferential direction. The base walls of the recesses 26 have a constant radius struck from the axis of the distributor member whilst the end walls have a radius substantially equal to the radii of the rollers. Located in each recess, is a roller 27. FIG. 3 shows three stages in the operation of the pump. In the upper Figure of FIG. 3 the roller 24 is in engagement with the roller 27 and inward movement is being imparted to the plunger 9. The initial engagement of the plungers urges the rollers 27 against an end wall of the recess, the direction of rotation of the distributor member being indicated by the arrow. The line of thrust is also indicated and as inward movement of the plunger takes place the line of thrust moves about the axis of the roller 27 towards the axis of rotation of the distributor member. When the line of thrust is in line with the axis of rotation of the distributor member the maximum inward movement of the plunger 9 has occured and during this movement the roller 24 is able to rotate in its shoe in the clockwise direction as seen in FIG. 3. The second view shows the position of maximum inward movement of the plunger and hence the end of pumping. As the distributor member continues to rotate the line of thrust moves to the opposite side of the axis of rotation and drives the roller along the recess 26 in the direction opposite to that of the distributor member. This action takes place very quickly and hence there is a rapid outward movement of the plunger and hence a rapid reduction in the fuel pressure within the passages in the distributor member and the various passages connected therewith. It will be noted that as the roller 27 is moved away from the aforesaid end wall of the recess 26, it also rotates and the direction of rotation of the two rollers is such that no skidding takes place therebetween.

Figure 4:
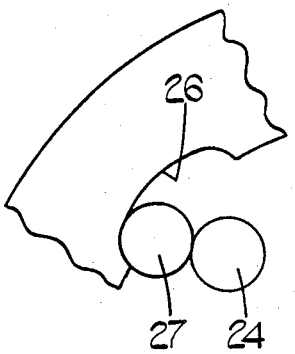
FIG. 4 shows a further modification.

In FIG. 4 there is shown a modification to the shape of the base wall of the recess 26. The end wall of the recess i.e. that portion of the recess against which the roller 27 is driven when contact of the rollers takes place, has a radius substantially equal to the radius of the roller 27 however, the adjacent portion of the recess has an increasing radius and the effect of this is to permit the roller 27 to start to roll slightly before the position shown in the second figure of FIG. 3. As a result the outward movement of the plunger takes place earlier than is the case with the arrangement shown in FIG. 3. The practical effect of this is that the rate of inward movement of the plunger during the final portion of the pumping stroke is higher than in the arrangement shown in FIG. 3.

Figure 5:
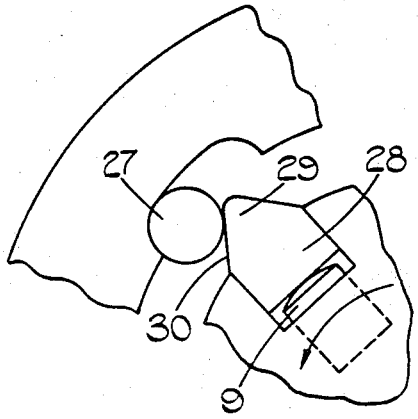
FIG. 5 shows a still further modification of the pump.

One disadvantage of the arrangement described is that it is difficult to control the rate at which the plunger moves inwardly except by variation of the size of the rollers and the initial and final contact angle. In order to overcome this difficulty the construction shown in FIG. 5 can be adopted. Referring now to FIG. 5 the roller 24 is omitted and the follower at 28 is provided with a projection 29 having a leading face 30 which engages the roller. The face 30 can be shaped to provide the required rate of inward movement of the plunger 9. With this arrangement skidding of the roller does take place.

In both arrangements torque reversal that is to say a reversal of the torque applied to the ring 25 does not occur as it does in the case of the cam ring 15 of the conventional pumping apparatus.

I claim:

1. A rotary drive fuel injection pump for supplying fuel to an internal combustion engine comprising a rotary member driven in use, in timed relationship with an associated engine, a bore formed in the rotary member, a plunger in said bore, means for imparting inward movement to said plunger as the rotary member rotates, passage means for conveying fuel displaced from said bore whilst the plunger is moved inwardly, to an outlet which in use is connected to an injection nozzle of the engine, the means for imparting inward movement allowing limited outward movement of the plunger whilst the bore is in communication with the outlet, the means for imparting inward movement to the plunger comprises a follower operatively connected to the plunger and rotatable therewith, and a roller located in a recess in a part retained against rotational movement, said recess extending in the direction of rotation of the rotary member, the arrangement being such that when the follower engages the roller the latter is driven against one end wall of the recess and inward movement is imparted to the plunger, the roller being driven away from said end wall as the follower moves over the roller thereby allowing rapid outward movement of the plunger.

2. A pump according to claim 1 in which said follower comprises a roller mounted in a shoe in engagement with said roller.

3. A pump according to claim 1 in which said follower comprises a part in engagement with said roller said part having a shaped projection defining a leading face engageable with said roller to effect inward movement of the plunger.

4. A rotary drive fuel injection pump for supplying fuel to an internal combustion engine comprising a rotary member driven in use, in timed relationship with an associated engine, a bore formed in the rotary member, a plunger in said bore, means for imparting inward movement to said plunger as the rotary member rotates, passage means for conveying fuel displaced from said bore while the plunger is moved inwardly, to an outlet which in use is connected to an injection nozzle of the engine, the means for imparting inward movement allowing limited outward movement of the plunger while the bore is in communication with the outlet, the means for imparting inward movement to the plunger comprises a follower operatively connected to the plunger and rotatable therewith, and a roller located in a recess the direction of rotation of the rotary member, the arrangement being such that when the follower engages the roller the latter is driven against one end wall of the recess and inward movement is imparted to the plunger, the roller being driven away from said end wall as the follower moves over the roller thereby allowing rapid outward movement of the plunger.

5. A rotary drive fuel injection pump for supplying fuel to an internal combustion engine comprising a rotary member driven in use, in timed relationship with an associated engine, a bore formed in the rotary member, a plunger in said bore, means for imparting inward movement to said plunger as the rotary member rotates, passage means for conveying fuel displaced from said bore while the plunger is moved inwardly, to an outlet which in use is connected to an injection nozzle of the engine, the means for imparting inward movement allowing limited outward movement of the plunger while the bore is in communication with the outlet, the means for imparting inward movement to the plunger comprises a first roller mounted in a shoe in engagement with said plunger and rotatable therewith, and a second roller located in a recess in a part retained against rotational movement, the base wall of said recess being of constant radius struck from the axis of rotation of said rotary member and said recess extending in the direction of rotation of the rotary member, the arrangement being such that when the first roller engages the second roller the latter is driven against one end wall of the recess and inward movement is imparted to the plunger, the second roller being driven away from said end wall as the first roller moves over the second roller thereby allowing rapid outward movement of the plunger.

6. A rotary drive fuel injection pump for supplying fuel to an internal combustion engine comprising a rotary member driven in use, in timed relationship with an associated engine, a bore formed in the rotary member, a plunger in said bore, means for imparting inward movement to said plunger as the rotary member rotates, passage means for conveying fuel displaced from said bore while the plunger is moved inwardly, to an outlet which in use is connected to an injection nozzle of the engine, the means for imparting inward movement allowing limited outward movement of the plunger while the bore is in communication with the outlet, a roller located in a recess in a part retained against rotational movement, the base wall of said recess being of constant radius struck from the axis of rotation of said rotary member and said recess extending in the direction of rotation of the rotary member, and the means for imparting inward movement to the plunger comprises a part operatively connected to the plunger and rotatable therewith, said last named part being in engagement with said roller and having a shaped projection defining a leading face engageable with said roller to effect inward movement of the plunger, the arrangement being such that when the follower engages the roller the latter is driven against one end wall of the recess and inward movement is imparted to the plunger, the roller being driven away from said end wall as the follower moves over the roller thereby allowing rapid outward movement of the plunger.

7. A rotary drive fuel injection pump for supplying fuel to an internal combustion engine comprising a rotary member driven in use, in timed relationship with an associated engine, a bore formed in the rotary member, a plunger in said bore, means for imparting inward movement to said plunger as the rotary member rotates, passage means for conveying fuel displaced from said bore while the plunger is moved inwardly, to an outlet which in use is connected to an injection nozzle of the engine, the means for imparting inward movement allowing limited outward movement of the plunger while the bore is in communication with the outlet, the means for imparting inward movement to the plunger comprises a follower operatively connected to the plunger and rotatable therewith, and a roller located in a recess in a part retained against rotational movement, said recess extending in the direction of rotation of the rotary member, the arrangement being such that when the follower engages the roller the latter is driven against one end wall of the recess and inward movement is imparted to the plunger, the roller being driven away from said end wall as the follower moves over the roller thereby allowing rapid outward movement of the plunger, the base wall of the recess increasing in radius from the end wall of the recess against which the roller in the recess is driven during inward movement of the plunger.

8. A rotary drive fuel injection pump for supplying fuel to an internal combustion engine comprising a rotary member driven in use, in timed relationship with an associated engine, a bore formed in the rotary member, a plunger in said bore, means for imparting inward movement to said plunger as the rotary member rotates, passage means for conveying fuel displaced from said bore while the plunger is moved inwardly, to an outlet which in use is connected to an injection nozzle of the engine, the means for imparting inward movement allowing limited outward movement of the plunger while the bore is in communication with the outlet, the means for imparting inward movement to the plunger comprises a first roller mounted in a shoe in engagement with said plunger and rotatable therewith, and a second roller located in a recess in a part retained against rotational movement, said recess extending in the direction of rotation of the rotary member, the arrangement being such that when the first roller engages the second roller the latter is driven against one end wall of the recess and inward movement is imparted to the plunger, the second roller being driven away from said end wall as the first roller moves over the second roller thereby allowing rapid outward movement of the plunger, the base wall of the recess increasing in radius from the end wall of the recess against which the second roller in the recess is driven during inward movement of the plunger.

* * * * *